United States Patent [19]

Kollmann

[11] 4,095,573

[45] Jun. 20, 1978

[54] ARRANGEMENT FOR CONTROLLING THE INJECTION QUANTITY OF AN INJECTION INTERNAL COMBUSTION ENGINE

[75] Inventor: Karl Kollmann, Leonberg, Germany

[73] Assignee: Daimler-Benz Aktiengesellschaft, Germany

[21] Appl. No.: 723,033

[22] Filed: Sep. 13, 1976

[30] Foreign Application Priority Data

Sep. 13, 1975 Germany ..... 2540986

[51] Int. Cl.[2] ..... F02D 1/04

[52] U.S. Cl. ..... 123/140 MP; 123/140 R

[58] Field of Search ..... 123/140 R, 140 FG, 140 MP

[56] References Cited

U.S. PATENT DOCUMENTS

| | | | |
|---|---|---|---|
| 2,350,781 | 6/1944 | Lichte | 123/140 MP |
| 2,588,119 | 3/1952 | Hurst | 123/140 R |
| 2,633,115 | 3/1953 | Waving | 123/140 MP |
| 2,667,153 | 1/1954 | Bensinger | 123/140 MP |
| 2,808,819 | 10/1957 | Hagele et al. | 123/140 MP |
| 2,900,969 | 8/1959 | Udale | 123/140 MP |
| 2,935,063 | 5/1960 | Zubaty | 123/140 MP |
| 3,707,144 | 12/1972 | Galis et al. | 123/140 MP |
| 3,820,519 | 6/1974 | Suda et al. | 123/140 MP |
| 3,960,127 | 1/1976 | Vuaille | 123/140 MP |
| 3,973,541 | 8/1976 | Nakamura et al. | 123/140 R |
| 4,015,573 | 4/1977 | Okura et al. | 123/140 MP |

FOREIGN PATENT DOCUMENTS

| | | | |
|---|---|---|---|
| 1,069,420 | 5/1960 | Germany | 123/140 MP |
| 1,108,510 | 6/1961 | Germany | 123/140 MP |
| 1,029,192 | 4/1958 | Germany | 123/140 MP |

*Primary Examiner*—Charles J. Myhre
*Assistant Examiner*—David D. Reynolds
*Attorney, Agent, or Firm*—Craig & Antonelli

[57] ABSTRACT

A control arrangement for the injection quantity of an internal combustion engine in which an adjusting member for the adjustment of the feed quantity of a fuel injection pump is adapted to be adjusted by a longitudinally displaceable diaphragm bolt of a pneumatic measuring mechanism by way of a control lever, whereby the diaphragm of the pneumatic measuring mechanism is acted upon on the one side by atmospheric pressure and is exposed on the other side thereof to the pressure in a vacuum chamber connected by way of a vacuum line with a part of the suction pipe of the internal combustion engine where the vacuum in the suction pipe is being picked-up particularly in a Venturi pipe section thereof; the control lever is thereby pivotally supported with its end opposite the adjusting member of the injection pump on a part operatively connected with the engine output control member and is adapted to be adjusted about this point of pivotal support by the diaphragm-bolt engaging in the central area of the control lever; additionally, the control lever is adjustable within the pivot plane thereof by the part actuatable by the output control member of the internal combustion engine; additionally, the flow cross section of the Venturi pipe section and therewith also of the suction pipe of the internal combustion engine is not adapted to be throttled so that the cross section remains essentially constant.

19 Claims, 5 Drawing Figures

ARRANGEMENT FOR CONTROLLING THE INJECTION QUANTITY OF AN INJECTION INTERNAL COMBUSTION ENGINE

The present invention relates to an arrangement for controlling the injection quantity of an injection internal combustion engine, especially of a Diesel passenger motor vehicle internal combustion engine.

For purposes of controlling the injection quantity of injection-type internal combustion engines, in addition to mechanical controllers, in which the mechanical interaction of the output lever, for example, of the drive pedal of a motor vehicle Diesel engine, on the adjusting member for the adjustment of the feed quantity of a fuel-injection pump is controlled by an override in the idling range and in the maximum end rotational speed range by a centrifugal governor provided with deflectable flyweights, whereas the combustion air can be supplied to the working cylinders of the internal combustion engine in an unthrottled manner with a correspondingly favorable filling degree, so-called pneumatic rotational speed controllers are known in the art, in which the output lever controls a throttle valve arranged in the suction pipe of the internal combustion engine whereas the adjusting member of the injection pump is controlled by way of a diaphragmblot of a pneumatic measuring device of the controller, whose vacuum chamber is connected by way of a vacuum line with a pressure pick-up place located in the suction pipe at the place of the throttle valve. In passenger motor vehicle Diesel engines, one has heretofore preferred the aforementioned pneumatic rotational speed controller or governor by reason of the smaller space requirement and of the simpler construction as well as of the lower manufacturing price, of which the pneumatic rotational speed controller or governor described in the German Pat. No. 1,069,420 is typical of the prior art. On the other hand, such pneumatic control arrangements satisfy to an everlesser extent the increasing demands which are made of the present Diesel engines as regards output, adaptation to automatic transmissions as well as exhaust gas and smoke behavior. For purposes of avoiding a soot which occurs during the fast acceleration, i.e., during the fast depressing of the drive pedal, it has been proposed in connection with a similar pneumatic control system described in the German Offenlegungsschrift No. 2,350,224, to set upon the side of the diaphragm of the measuring device disposed opposite the vacuum chamber exclusively by way of an adjustable throttle place with the atmospheric air pressure or outside air pressure. It is achieved thereby that the diaphragm bolt during the fast acceleration and during the corresponding rapid opening of the throttle valve cannot be displaced equally rapidly toward the outside by the idling spring of the measuring device and therewith the adjusting member of the injection pump cannot be displaced so fast toward the full load quantity as would be the case with an unthrottled actuation of the outer side of the diaphragm with atmospheric air. However, it is disadvantageous in connection therewith that, for purposes of the correct control of the throttle place in dependence on the velocity of the throttle valve actuation, a complicated and costly electronic control unit is required, which is not only expensive in manufacture but is also prone to troubles and failures with its numerous sensitive structural parts. Especially with the modern passenger motor vehicle Diesel engines of larger power output, one has therefore returned again to the mechanical idling-end rotational speed controllers or governors and has thereby accepted the greater manufacturing expenditure and space requirement.

Since the flow cross section at the pressure pick-up place influences the picked-up pressure, as to the rest the further disadvantage exists by the heretofore customary pressure pick-up for the pneumatic measuring device from the area of the throttle valve of the suction pipe that for each throttle valve position another vacuum curve as a function of rotational speed of the internal combustion engine will establish itself. Consequently, a certain pressure parabola is coordinated to each rotational speed of the engine of which only a small pressure range is processed in the governor or controller measuring device, from which follows further that the heretofore used pneumatic controller or governor can operate only as all-rotational speed or adjusting controller or governor.

The present invention is concerned with the task to so modify a pneumatic control arrangement of the type known in the prior art and at the same time to so simplify the same to the extent possible that notwithstanding a more simple and less expensive construction thereof compared to the mechanically acting centrifugal governors, it satisfies fully all requirements heretofore fulfilled only by these centrifugal governors or controllers.

The underlying problems are solved according to the present invention in that a control lever is pivotally supported with its end opposite the adjusting member of the fuel injection pump at an actuating member and is adjustable at this bearing point with an increasing output adjustment in the same direction as the movement of the diaphragm-bolt of the pneumatic measuring device with an increasing vacuum in the Venturi pipe connected in the suction pipe of the engine to which the vacuum chamber of the measuring device is connected by way of a vacuum line. Additionally, the flow cross section of the Venturi pipe section is devoid of any throttling means whence also the flow cross section of the suction pipe of the internal combustion engine is devoid of any throttling means. Furthermore, in a preferred embodiment according to the present invention, the control lever is adjustable approximately to the same extent as the engaging place of the diaphragm bolt in the central area of the control lever.

With such a construction of the control arrangement not only the throttle valve control heretofore absolutely necessary with all pneumatic controllers can be dispensed with and therewith also the filling loss unavoidable by the throttle valve resistance in the suction pipe, but a single vacuum parabola results therefrom at the same time as vacuum signal for the measuring device of the pneumatic controller over the entire rotational speed range of the internal combustion engine so that in conjunction with the additional control of the control lever from the output lever or drive pedal, a control characteristic can be attained which corresponds to all requirements of a filling controller or governor. Since for the determination of the shifting point of an automatic transmission not only a rotational speed signal is available but also a torque signal, a particularly good matching of the control arrangement to an automatic transmission results therefrom. Nonetheless, the noises occurring in mechanical controllers or governors and the lubrication requirements are dispensed with. The absence of a throttle valve therebeyond reduces the shut-off difficulties occuring with the heretofore customary pneumatic controllers or governors in the case of a possible backward running of the Diesel engine because the exhaust gases which in such a case leave or are discharged in the direction toward the throttle valve, can no longer be dammed up at this location in the sense of a pressure build-up and of a corresponding increase of the injection quantity. Also, special measures for the adjustment of the fuel quantity for the starting of the internal combustion engines are dispensed with by the arrangement in accordance with the present invention because the starting quantity is possible anyhow only with a completely missing or absent vacuum signal and therewith with an internal combustion engine at standstill. This simplification makes it possible at the same time, if so desired, for example, during summer operation of the passenger motor vehicle, to depress the drive pedal only partly for the starting and therewith to reduce the danger of a blue smoke during the start. Finally, the controller of the pneumatic control arrangement in accordance with the present invention is suited in the same manner as the mechanical centrifugal controller or governor for taking into consideration special programs, for example, as step controller or governor, for achieving controlled intermediate rotational speeds for air conditioning systems, etc.

According to a preferred embodiment of the present invention, the vacuum line leading from the Venturi pipe section to the measuring device includes on the engine side a vacuum booster, in its turn connected to a vacuum pump of the internal combustion engine, and on the controller side a three-way control valve, by means of which the section of the vacuum line on the controller side is adapted to be selectively connected with the part of the vacuum line leading to the vacuum booster, directly with the vacuum pump or with the external atmosphere. By the use of this construction, a vacuum signal corresponding to all practical requirements can be achieved in this manner at any time, i.e., already in the lowest rotational speed range. According to another feature of the present invention, a drawspring may be provided which engages at a diaphragm of the vacuum booster and which determines the initial pressure effective therein, whereby the drawspring is adjustable in its tensional force. This arrangement is also favorable because the adjustability of the initial, predetermined pressure in the vacuum booster provides a simple possibility for the matching of the controller to unavoidable deviations of the power output of the internal combustion engine and therewith of the vacuum development in the Venturi pipe section.

A particularly favorable construction is obtained if the three-way control valve is at the same time a component of an ignition lock whose key is adapted to be selectively rotated from a shutting-off position, in which the measuring device is connected to the vacuum pump, into a starting position, in which the measuring device is connected with the atmosphere, and into a drive position, in which the measuring device is connected by way of the vacuum booster to the Venturi pipe section of the suction pipe. An actuation of a Diesel engine results therefrom which is greatly simplified compared to the heretofore customary actuating arrangements of Diesel engines and which corresponds approximately to the customary carburetor engines.

Accordingly, it is an object of the present invention to provide an arrangement for the control of the injection quantity of an injection internal combustion engine which avoids by simple means the aforementioned shortcomings and drawbacks encountered in the prior art.

Another object of the present invention resides in a pneumatic control arrangement for controlling the injection quantity of an injection internal combustion engine which fully satisfies the present-day demands of Diesel engines, particularly as regards power output, matching to automatic transmissions as well as exhaust gas and smoke behaviors.

A further object of the present invention resides in an arrangement for the control of the injection quantity of an injection internal combustion engine of the aforementioned type which is simple in construction, requires relatively little space, and is highly reliable in operation.

Still a further object of the present invention resides in an arrangement for controlling the injection quantity of an injection internal combustion engine which obviates the need of complicated, costly electronic control units prone to failures due to the presence of numerous sensitive structural parts.

Another object of the present invention resides in a control arrangement of the type described above which provides all the advantages of the heretofore known pneumatic controllers, yet also satisfies fully all demands heretofore fulfilled only by centrifugal governors.

A further object of the present invention resides in an arrangement for controlling the injection quantity of an injection internal combustion engine in which unavoidable filling losses caused by the throttle valve resistance in the suction pipe is eliminated while a single vacuum parabola results over the entire rotational speed range of the internal combustion engine as vacuum signal for the measuring device.

Still another object of the present invention resides in a control arrangement for controlling the injection quantity of an injection-type internal combustion engine by means of which control characteristics corresponding to a filling controller or governor can be readily achieved.

Still another object of the present invention resides in an arrangement of the type described above which enables a particularly good adaptation to the control arrangement of an automatic transmission, eliminates noises and lubricating requirements of mechanical governors and avoids shutting off difficulties which occur at times with the prior art pneumatic controllers.

Another object of the present invention resides in a control arrangement of the type described above for controlling the injection quantity of an internal combustion engine which greatly simplifies the handling of a Diesel engine of a passenger motor vehicle during starting, driving and shutting off of the engine.

These and other objects, features and advantages of the present invention will become more apparent from the following description when taken in connection with the accompanying drawing which shows, for purposes of illustration only, one embodiment in accordance with the present invention, and wherein.

Figure 5:
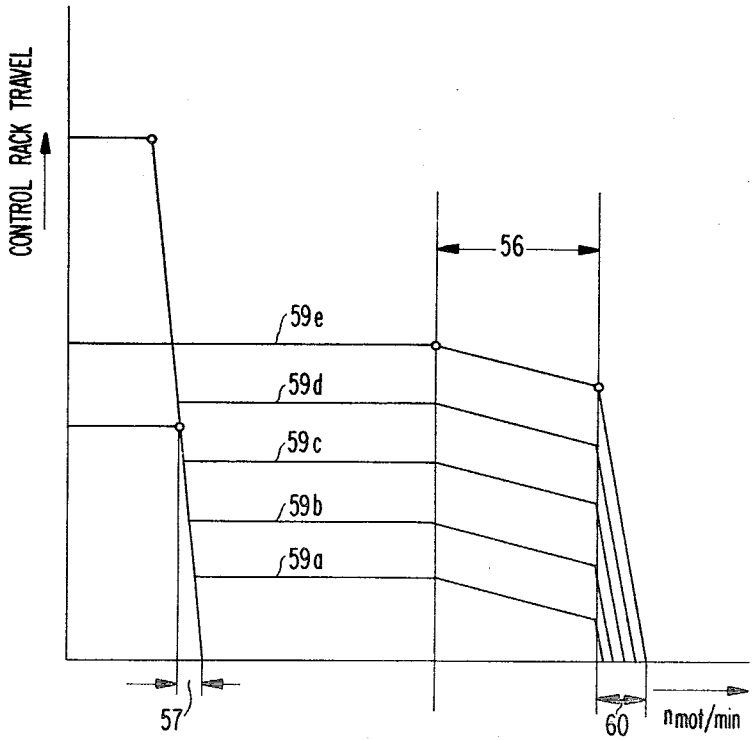
Figure 4:
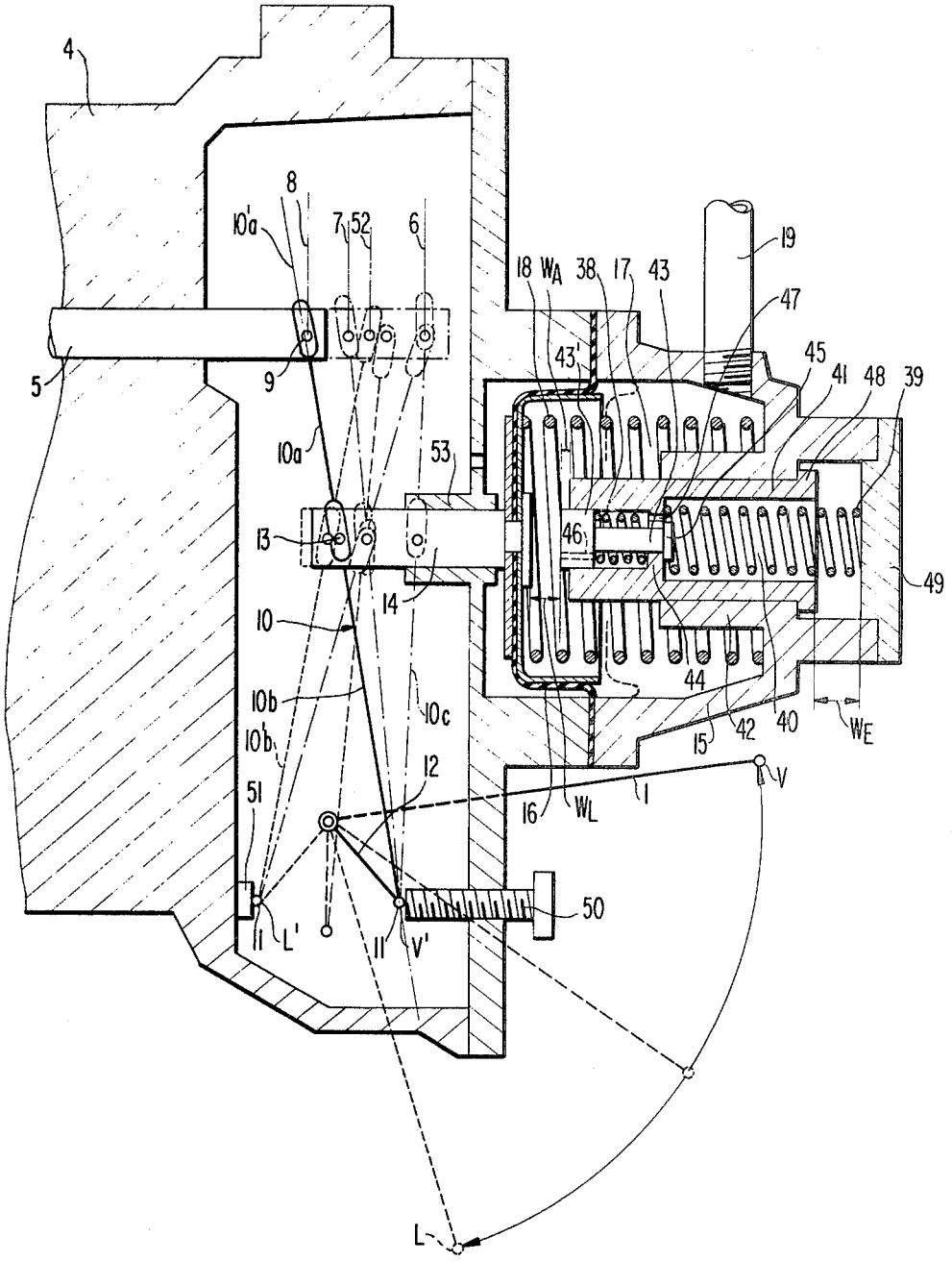

FIG. 4 is a partial cross-sectional view of the pneumatic controller of the control arrangement in accordance with the present invention illustrating more fully certain constructive features thereof; and FIG. 5 is a diagram illustrating the control path of the adjusting member of the injection pump as a function of engine rotational speed and therewith the control characteristic of the control arrangement in accordance with the present invention.

Figure 1:
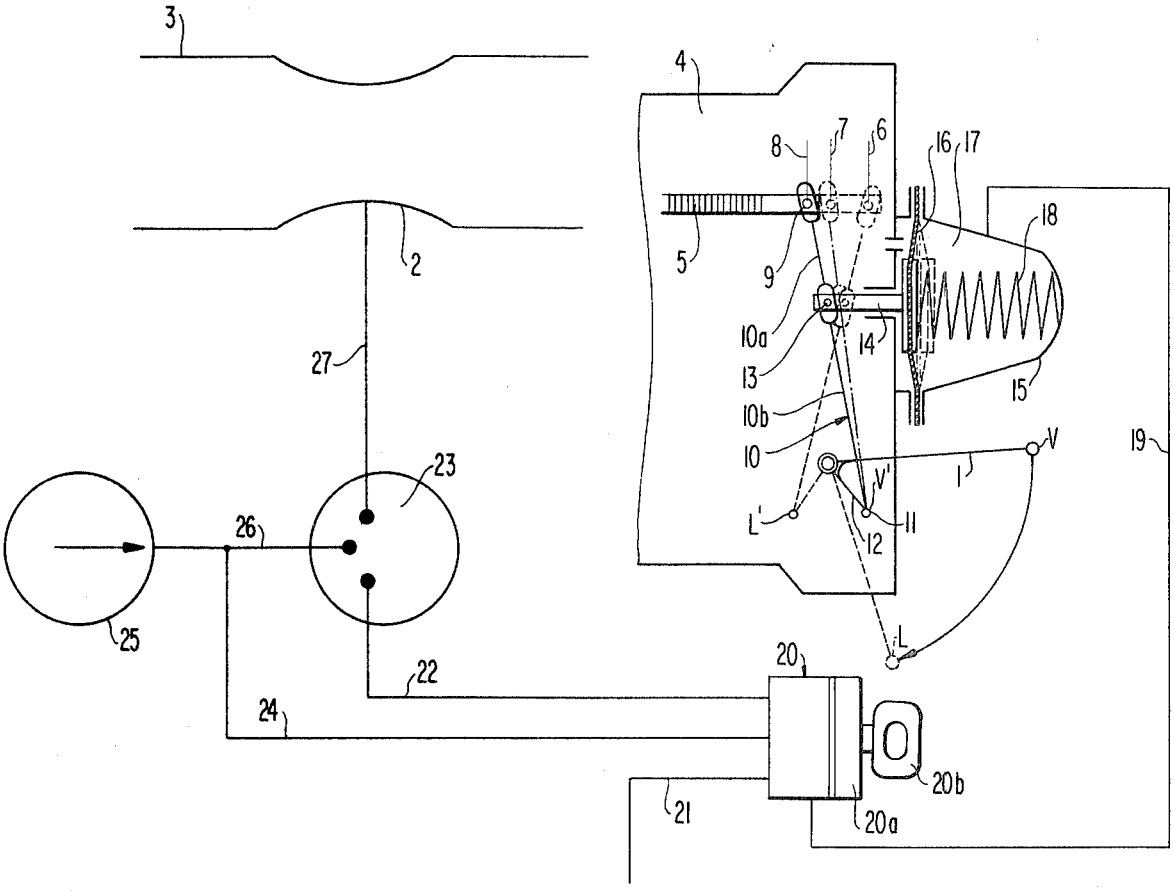
FIG. 1 is a schematic view of a simplified overall illustration of the control arrangement in accordance with the present invention.

Referring now to the drawing wherein like reference numerals are used throughout the various views to designate like parts, the control arrangement illustrated in FIG. 1 is intended for the control of the injection quantity of a passenger motor vehicle Diesel engine, of which only some component parts essential in conjunction with the control arrangement are schematically illustrated in the drawing thus, for example, a drive pedal 1, a section of a suction pipe 3 for the combustion air which contains a Venturi pipe 2 and an injection pump 4 for the fuel to be injected directly into the working cylinder of the internal combustion engine.

The injection pump 4 which is constructed according to the illustrated embodiment as conventional plunger pump includes in its upper area a control rod 5 constructed as toothed rack, whereby the individual plungers can be rotated by the longitudinal displacement of the toothed rack 5 in the sense of a corresponding metering of the feed quantity in fuel. The illustrated control rack 5 can be displaced from a stop position 6 corresponding to zero feed by way of a full-load position 7 up to into a start position 8 and for this purpose is pivotally connected by way of a pivotal connecting place 9 located at its right end in FIG. 1, with an elongated control or attenuating lever 10 whose pivotal bearing place 11 is located at the free end of a bell crank 12 in its turn pivotally supported at a fixed point, whose free lever arm forms in the schematic illustration simultaneously the drive pedal 1. Of course, the bell crank 12 in a practical construction of the control arrangement is coupled only by way of a corresponding intermediate linkage with the drive pedal located in the passenger space. A further description of the injection pump 4, properly speaking, whose plunger is driven in the conventional manner by a cam shaft driven by the engine is dispensed with herein since it is well known in the art.

The control lever 10 includes between its ends an engaging place 13 for a diaphragm-bolt 14 of a measuring mechanism 15 to be described more fully hereinafter by means of which it can be displaced longitudinally in the illustrated manner parallelly to the control rack 5. The control lever 10 is subdivided into two lever arms 10*a* and 10*b* of different lengths by the engaging place 13 constructed as pivotal bearing place, by means of which it is made possible, taking into consideration the space available in a customary controller or governor portion of an injection pump, that the control lever 10 in its one boundary or limit position illustrated in full lines, in which the drive pedal 1 is in its full load position V shown in full line, in which simultaneously the diaphragm-bolt 14 is also in its outermost starting or initial position also illustrated in full line, displaces the control rack 5 into its starting position 8 corresponding to the greatest possible injection quantity, and that at the same time in the idling position L of the drive pedal 1 indicated in dash line in FIG. 1, the control lever 10 in its other limit position also indicated in dash lines displaces the control rack 5 into its stop position 6 disposed farthest toward the right in FIG. 1, in which no fuel is supplied. It is at the same time assumed in this position that the diaphragm 16 connected with the diaphragm-bolt 14 is stressed into the position also indicated in dash lines in FIG. 1 by a vacuum adduced in a vacuum chamber 17 of the measuring unit 15 in a manner to be described more fully hereinafter against the force of springs disposed therein, of which in FIG. 1 only an idling spring 18 is illustrated for the sake of simplicity, and as a result thereof holds fast the control rack 5 in the stop position 6.

In conjunction with the full load position of the drive pedal, finally a still further position of the control lever 10 is illustrated in FIG. 1 in dash-and-dotted lines which results when the Diesel engine rotates with its full-load rotational speed with the drive pedal position indicated in full lines. The corresponding full-load position 7 of the control rack 5 thereby results from the fact that an operational pressure difference to be described more fully hereinafter will establish itself at the diaphragm 16, as a result of which the diaphragm 16 will assume the position indicated in FIG. 1 in dash-and-dotted lines. It is furthermore apparent that the control lever 10 is pivoted out of the position illustrated in dash-and-dotted lines in case of a pivoting of the drive pedal 1 out of the aforementioned full load position in the direction toward the idling position between the full load position 7 and the stop position 6 of the control rack 5 and as a result thereof also any desired partial load positions of the control rack 5 can be adjusted as long as the diaphragm-bolt 14 is not pulled toward the right—in the sense of a zero feed of the injection pump—for example by reason of a correspondingly large vacuum in the vacuum chamber 17.

Whereas atmospheric pressure acts on the left side of the diaphragm 16 as viewed in FIG. 1, a pressure acts on the other side thereof which is produced in the vacuum chamber 17 by way of a vacuum line 19 connected thereat. The vacuum line 19 starts from a three-way control valve 20 whose valve body (not shown) of conventional construction forms simultaneously a component of an ignition lock 20*a* and is pivotal by way of an ignition key 20*b* in a manner not illustrated in detail into three different positions, and more particularly into a starting position, a driving position, and a shut-off position. The vacuum line 19 is thereby connected by way of the three-way control valve 20 in the starting position of the valve by way of a further line 21 with the atmospheric outside air, in the driving position of the valve by way of another vacuum line 22 to a vacuum booster 23 to be described more fully hereinafter and in the shut-off position of the valve again by way of another vacuum line 24 to a vacuum pump 25 of the passenger motor vehicle. It is apparent that the diaphragm 16 in the starting position of the ignition lock and with a corresponding identical pressure admission on both sides thereof is in the outermost position illustrated in FIG. 1 by reason of the force of the idling spring 18 effective at the same, in which also the diaphragm-bolt 14 is disposed in its starting or initial position illustrated in full lines, and in that in the shut-off position of the ignition lock the full vacuum of the vacuum pump 25 acts on the diaphragm 16 and pulls the diaphragm into the vacuum chamber 17 with a correspondingly large force.

The vacuum booster 23 is connected by way of a branch line 26 also with the vacuum pump 25 and by way of a further line 27 additionally with the Venturi pipe 2. According to FIG. 2, the pressure in the suction pipe picked up by way of the Venturi pipe section 2 acts by way of the line 27 on a diaphragm 29 disposed in the inlet chamber 28 of the vacuum booster 23 which, on the other side, is acted upon by outside atmospheric pressure. A bolt 30 axially secured at the diaphragm 29 extends through a corresponding outside atmospheric air chamber 31 of the vacuum booster 23 up to a diaphragm valve 32 which is operable to close off an outlet chamber 33 of the vacuum booster 23 connected with the vacuum line 23 with respect to the branch line 26 which leads by way of the vacuum line 24 to the vacuum pump 25 (FIG. 1).

Figure 2:
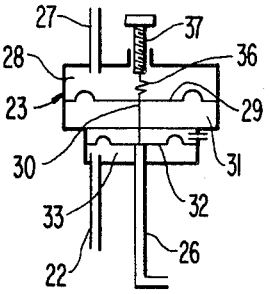
FIG. 2 is a schematic view of a vacuum booster used in the control arrangement of the present invention.

The operation of the vacuum booster 23 with increasing vacuum in the line 27 is apparent from the illustration of FIGS. 1 and 2:

If the vacuum increases in the line 27 with an increasing engine rotational speed in a known manner with the square of the engine rotational speed, then the correspondingly increased vacuum in the inlet chamber 28 effects an opening of the diaphragm valve 32 with respect to the branch line 26, as a result of which also the vacuum in the adjoining vacuum line 22 and therewith—in the drive position of the three-way control valve 20—by way of the vacuum line 19 also the vacuum prevailing in the vacuum chamber 17 is held for such length of time at a larger value with respect to the pressure in the inlet chamber 28 until the correspondingly increased vacuum which is effective at the diaphragm of the diaphragm valve 32 pulls by way of the bolt 30 the diaphragm 29 up to the closing position of the diaphragm valve 32.

As to the rest, the diaphragm valve 32 is constructed in a conventional manner as a double-valve which in case of exceeding a predetermined closing pressure with respect to the branch line 26 now opens in a conventional manner a connection from the outside air chamber 31 toward the outlet chamber 33. If the vacuum in the inlet chamber 28 decreases by reason of a correspondingly reduced engine rotational speed, then a correspondingly larger pressure acts on the bolt 30, which now leads to a connection of the outside air chamber with the outlet or discharge chamber 33—and therewith to a proportional decrease of the vacuum in the outlet chamber 33 and also in the vacuum chamber 17. This reduction of the vacuum in the vacuum chamber 17 takes place for such length of time until the diaphragm valve 32 again closes by reason of a renewed pressure balance in the vacuum booster 23. As a result thereof, the vacuum booster 23 assures at the same time that a vacuum will establish itself in the outlet chamber 33 which is proportionally larger compared to the pressure in the inlet chamber 28.

Figure 3:
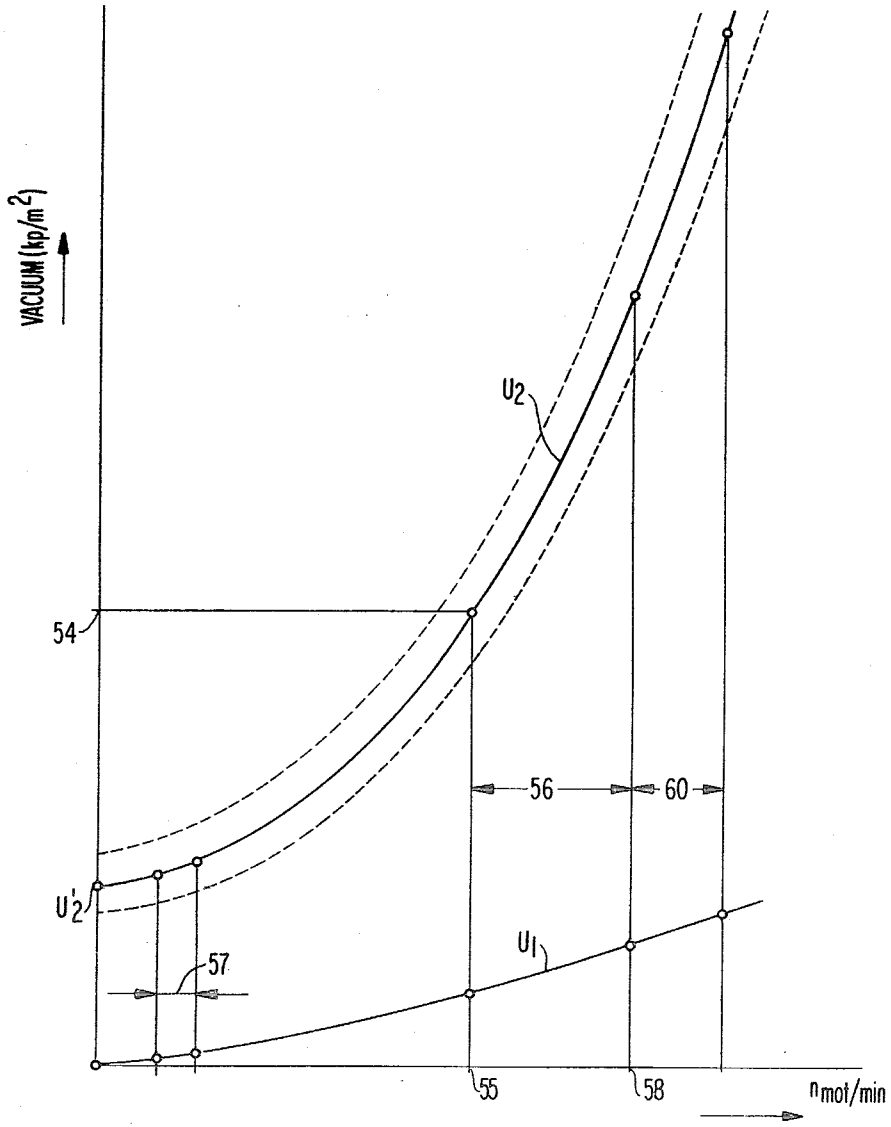
FIG. 3 is a diagram illustrating the vaccum curve in a vacuum chamber of a pneumatic measuring device of the control installation according to the present invention in which vacuum is plotted as a function of engine rotational speed.

FIG. 3 illustrates this interrelationship in a diagram, in which can be seen as a function of engine rotational speed $n_{mot/min}$, on the one hand the vacuum curve produced directly by the Venturi pipe 2 and, on the other, the vacuum curve increased by the vacuum booster 23 in respective full-line curves $U_1$ and $U_2$. The vacuum $U'_2$ thereby illustrates at the abscissa beginning simultaneously the pre-set or pre-adjusted vacuum which will establish itself in the outlet chamber 33 with atmospheric pressure prevailing in the inlet chamber 28. Both curves $U_1$ and $U_2$ are respective components of a parabola.

It can further be seen from FIG. 2 that additionally a drawspring 36 engages at the side of the diaphragm 29 opposite the bolt 30 which on the other side is held at the free end of an adjusting screw 37 extending outwardly through the housing of the vacuum booster 23. The pre-set vacuum $U'_2$ and therewith the shape of the curve $U_2$ can be increased or decreased by rotating the adjusting screw 37, as is indicated in FIG. 3 in dash lines. A simple possibility results therefrom for matching the control to different vacuum values by reason of the unavoidable differences of the output of the engine and therewith of the vacuum development in the Venturi pipe 2.

It can be seen from the illustration of FIG. 4, which is made in a more constructive manner, that the measuring device 15 of the control arrangement accommodates in its vacuum chamber 17, in addition to the idling spring 18, two further springs, namely, an adaptation spring 38 and an end control spring 39. These two springs 38 and 39 are guided in the two opposite end areas of an axial bore 40 of a piston 41 which, in its turn, is displaceable along a cylindrical guidance 42 extending in the vacuum chamber 17 coaxially to the diaphragm bolt 14. The adaptation spring 38 is thereby traversed by a plunger 43 which on the diaphragm side serves with an outer collar 43' for the support thereat of the adaptation spring 38 which, on the other end, is supported at a partition wall 44 of the piston 41. The plunger 43 extends through the partition or intermediate wall 44 in an axial bore and is provided at the end thereof with an outer collar 45 supported at the partition or intermediate wall 44. In addition thereto, small bores 46 and 47 extending through the outer collar 43' and the intermediate wall 44 assure a pressure equalization between the vacuum chamber 17 connected to the vacuum line 19 and the parts of the bore 40 disposed on both sides of the intermediate wall 44.

As can be further seen from FIG. 4, the piston 41 includes at its end opposite the diaphragm 16 additionally outer collar 48 supported at the cylindrical guidance 42 forming a housing component of the measuring device 15, whereas the end control spring 39 is supported with its end opposite the intermediate wall 44 at the housing bottom 49 of the measuring device 15 located thereat. Both the adaptation or equalization spring 38 as also the end control spring 39 are received thereby in the bore 40 with a certain prestress which is necessary in order that during the operation of the control arrangement the aimed-at control characteristics of a filling controller or governor which can be seen from FIG. 5, can be attained. According to this control characteristic, one aims at an operation pursuant to which the control rack 5 of the injection pump 4 after the starting of the Diesel engine with a drive pedal 1 disposed in the full-load position V is retracted out of its starting position 8 with maximum injection quantity immediately into its full-load position 7 as long as the drive pedal 1 is held in its full-load position, in which the bell crank 12 abuts as to the rest at an abutment screw 50 adjustably guided in the housing of the injection pump 4. Of course, the person operating the drive pedal 1 will immediately release the drive pedal 1 after the starting of the unclutched Diesel engine whereby the drive pedal 1 by reason of the force of a return spring of conventional type (not shown) pivots into its idling position L indicated in dash line in FIG. 4, in which the bearing point 11 of the control lever 10 abuts corresponding to its idling position L' at an idling abutment 51 of the injection pump 4. This leads to the fact that the control lever 10 further retracts the control rack 5, and more particularly at least so far that the point of pivotal connection 9 thereof (FIG. 1)—in case of a minimum idling rotational speed—is now in a position 52 in which the maximum idling quantity of fuel is injected.

It might be noted at this point that the engaging place 13 of the diaphragm bolt 14 at the control lever 10 is disposed further outside than with the starting position explained hereinabove. Whereas the outermost position of the diaphragm-bolt 14 is given by the support of the diaphragm 16 at a bush 53 guiding the diaphragm-bolt 14, the starting position of the control lever 10 results, on the one hand, by the abutment of the bell crank 12 at the abutment screw 50 and, on the other, by the end of the movability of the control rack 5 in the direction of an increase of the injection quantity in the starting position 8. Consequently, a certain displacement of the diaphragm-bolt 14 into the vacuum chamber 17, indicated in FIG. 4, may necessarily result in the starting position.

As soon as the idling rotational speed increases with warming-up Diesel engine and corresponding reduction of the friction resistances, according to FIG. 3 also the vacuum at the Venturi pipe 2 increases and therewith the vacuum in the vacuum chamber 17, which leads to the fact that now the atmospheric air pressure acting on the diaphragm 16 outside the vacuum chamber 17 displaces the diaphragm 16 toward the right as viewed in FIG. 4 against the force of the idling spring 18, which is possible in the operating range of the idling spring 18 up to the abutment of the inner end of the diaphragm-bolt 14 which is connected with the diaphragm 16, at the outer collar 43' of the plunger 43. As a result thereof, the control lever 10 which continues to be located with its bearing place 11 at the idling abutment 51, is pivoted in the clockwise direction as viewed in FIG. 4 and the control rack 5 is displaced correspondingly further toward its stop position. The characteristics of the idling spring 18 are matched, of course, to the idling path $W_L$ (FIG. 4) of the diaphragm-bolt 14 in such a manner that the injection quantities of the injection pump 4 which are made possible therewith in the idling position L of the drive pedal, keep the output of the Diesel engine correspondingly throttled.

If the drive pedal 1 is now actuated out of the idling position L, then as a result thereof the engaging place 13 of the diaphragm-bolt 14 at first becomes a pivot axis for the control lever 10, whose bearing place 11 now travels toward the right as viewed in FIG. 4, whereby simultaneously the control rack 5 is displaced out of its maximum idling position 52 which it has assumed, for example, beforehand, toward the left, i.e. towards its full-load position 7. The increase of the injection quantity adduced thereby leads to a corresponding rotational speed increase of the Diesel engine with an increase in the same sense of the vacuum in the Venturi pipe 2 and in the vacuum chamber 17. On the other hand, the prestress of the adaptation spring 38 is so selected that a further inward movement of the diaphragm-bolt 14 which was previously supported at the outer collar 43' of the plunger 43, becomes possible only when the vacuum in the vacuum chamber exceeds a value 54 which can be seen from FIG. 3, to which is coordinated a predetermined engine rotational speed 55 corresponding to the "adaptation beginning" to be explained more fully hereinafter. This is so as with an engine rotational speed which thereupon continues to increase, the feed quantity increases slightly in dependence on the rotational speed with the piston-injection pumps of the type with which the present invention is concerned, without any displacement of the control rack in the direction toward a larger feed quantity. This undesired increase of the injection quantity with an unchanged position of the drive pedal with an increasing rotational speed is reduced in that an adaptation or equalization range 56 follows the adaptation or equalization beginning with higher rotational speed, in which the injection quantity is held to the same value with an increasing rotational speed in that now the diaphragm-bolt 14 is now able to displace with an increasing vacuum in the vacuum chamber 17 the plunger 43 against the force of the adaptation or equalization spring 38 by a corresponding adaptation or equalization path $W_A$, which leads to a corresponding pivot movement of the control lever 10 in the clockwise direction and therewith to a corresponding displacement of the control rack 5 in the direction toward the stop position 6.

It follows therefore from the preceding that the engine rotational speed is able to vary corresponding respectively to the engine load between the idling range 57 (FIG. 3) and the maximum rotational speed 58 of the adaptation or equalization range 56 with an unchanged position of the drive pedal 1 and without any change of the injected fuel quantity. The injected fuel quantity—and therewith the "filling" of the working cylinders—can thus be selected in the normal driving range exclusively by a corresponding adjustment of the drive pedal 1 which is indicated in FIG. 5 by the essentially horizontally extending curves **59*a* to 59*e*, of which each corresponds to a predetermined load adjustment of the drive pedal 1** between the idling position L and the full-load position V.

Insofar as the engine rotational speed should increase beyond the rotational speed 58 attained at the end of the adaptation range 56 which is the maximum permissive rotational speed in continuous operation, also the vacuum in the Venturi pipe 2 and in the vacuum chamber 17 further increases slightly which now has as a consequence that the diaphragm 16 abutting at left end of the piston 41 displaces the same against the force of the end control spring 39 which after traversing the end control path $W_E$ (FIG. 4) coordinated to an end control range 60 of the control characteristics according to FIG. 5, finally leads to the fact that the control lever 10 retracts the control rack 5 completely into its stop position 6 even with a drive pedal 1 disposed in its full-load position V.

If the Diesel engine is to be shut off, then the ignition lock **20*a* is displaced in the manner already described into the shutting off position, in which the vacuum chamber 17 according to FIG. 1 is connected by way of the vacuum lines 19 and 24 directly with the vacuum pump 25 of the vehicle. As a result thereof, the diaphragm 16, in the same manner as in the end control range 60 described above, is retracted completely into the vacuum chamber 17 and the control rack 5** is displaced in the described manner into its stop position.

The preceding cooperation of the control lever 10 with the control rack 5, the diaphragm-bolt 14 and the drive pedal 1 also follows from the fact that the engaging place 13 of the diaphragm-bolt 14 at the control lever 10 in the initial position of the diaphragm-bolt 14 lies approximately on the connecting line **10'*a* between the full-load position V' of the aforementioned bearing point 11 and of the starting position 8 of the point of pivotal connection 9 of the control lever 10 and at the same time approximately on the connecting line 10'b between the idling position L' of the bearing point 11 and the maximum idling position 52 of the point of pivotal connection 9 and, in the end position of the diaphragm-bolt 14, on the connecting line 10c between the full load position V' of the bearing place 11 and of the stop position 6 of the point of pivotal connecting place 9**.

It follows additionally from the preceding that the construction of the measuring device illustrated in FIG. 4 is coordinated already to a predetermined construction of the injection pump 4. Of course, the control arrangement according to the present invention is suited also for injection systems with other injection pumps, for example, with diaphragm pumps, in which case the measuring device has to be coordinated to the feed characteristics of this pump. Furthermore, it is also feasible within the scope of the present invention that, in a simplified construction of the control arrangement, the vacuum boost means provided in the described embodiment is dispensed with.

While I have shown and described only one embodiment in accordance with the present invention, it is understood that the same is not limited thereto but is susceptible of numerous changes and modifications as are known to those skilled in the art, and I therefore do not wish to be limited to the details shown and described herein but intend to cover all such changes and modifications as are encompassed by the scope of the appended claims.

I claim:

1. An arrangement for the control of the injection quantity of an injection internal combustion engine, comprising a suction pipe, a fuel injection pump being connected to the suction pipe and having an adjusting means for adjusting the feed-quantity of the fuel, a pneumatic measuring means including a diaphragm means and a longitudinally displaceable diaphragm-bolt operatively connected with said diaphragm means, means including a control lever means for adjusting the adjusting means of the fuel pump by said diaphragm-bolt, said diaphragm means being acted upon on one side substantially by the outside air pressure and partially delimiting on the other side a vacuum chamber formed in said measuring means, idling spring means in said vacuum chamber urging the diaphragm means and therewith the diaphragm - bolt outwardly in the direction toward an increase of the feed quantity, and vacuum chamber being in communication by way of a vacuum line means with a part of the suction pipe, an outward member for the internal combustion engine, the pivot point of the control lever means being additionally adjustable within the pivot plane of the control lever means at least indirectly by said output control member, characterized in that the suction pipe includes a non-throttlable Venturi section, the control lever means is supported at a pivot point with its end opposite said adjusting means on an actuating member operatively connected with said output control member, said diaphragm-bolt engaging said control lever means in its central area to retract said diaphragm-bolt inwardly with an increasing vacuum in said vacuum chamber and therewith displace said adjusting means to smaller injection quantities by pivoting the control lever means about its pivot point on said actuating member, and said control lever means being adjustable at said pivot point with an increasing output adjustment of said output control member substantially in the same direction as the diaphragm-bolt movement with an increasing vacuum in said vacuum chamber.

2. An arrangement according to claim 1, characterized in that the vacuum chamber is operatively connected by way of the vacuum line means with the Venturi pipe section in the suction pipe of the internal combustion engine, substantially all of the combustion air flowing through said Venturi pipe section.

3. An arrangement according to claim 1, characterized in that the suction pipe is non-throttlable because the Venturi pipe section is devoid of a throttle valve.

4. An arrangement according to claim 1, characterized in that said adjusting means is a control rack, said output control member is a drive pedal and said actuating member is a bell crank.

5. An arrangement according to claim 1, characterized in that the pivot point of said control lever means on said actuating member is adjustable substantially parallelly to the adjustment direction of said diaphragm bolt and approximately to the same extent as the engaging place of the diaphragm bolt on said control lever means.

6. An arrangement according to claim 5, characterized in that the control travel of said diaphragm bolt is subdivided from the outermost position thereof in relation to the vacuum chamber, with increasing vacuum in said vacuum chamber, into an idling travel against the sole action of an idling spring, an adjoining adaptation travel with additional counter-force of an adaptation spring and an end-control travel following said adaptation travel and leading to the end position of said diaphragm bolt with an end-control spring further opposing the end-control travel of said diaphragm bolt.

7. An arrangement according to claim 6, characterized in that the engaging place of the diaphragm bolt at the control lever means is located, in the initial position of the diaphragm bolt, approximately on the connecting line between the full-load position of said pivot point and of the start-position of the point of pivotal connection of the control lever means on said adjusting means and at the same time approximately on the connecting line between the idling position of said pivot point and the maximum idling position of said point of pivotal connection, and in the opposite end position of the diaphragm bolt, at least approximately on the connecting line between the full-load position of said pivot point and the stop position of said point of pivotal connection.

8. An arrangement according to claim 7, characterized in that the full-load position of the actuating member is adjustable by means of an abutment member adjustably received in the housing of the injection pump.

9. An arrangement according to claim 8, characterized in that said vacuum line means includes in the line section thereof on the engine side a vacuum-booster means connected to a vacuum pump and in the line section thereof on the control side, a three-way control valve means operable to selectively connect the line section on the control side, with the line section leading to the vacuum-booster means, directly with the vacuum pump or with the atmosphere.

10. An arrangement according to claim 9, characterized in that the vacuum-booster means includes a diaphragm and a drawspring engaging at said diaphragm and determining the initial pressure effective therein, said drawspring being adjustable in its tension force.

11. An arrangement according to claim 10, characterized in that the three-way valve means is at the same time a component of an ignition lock means whose key is selectively rotatable from a shut-off position, in which the measuring means is connected with the vacuum pump, into a starting position in which the measuring means is connected with the atmosphere, and into a drive position in which the measuring means is connected with the Venturi section of the suction pipe by way of said vacuum booster means.

12. An arrangement according to claim 11, characterized in that the internal combustion engine is a Diesel-passenger motor vehicle internal combustion engine.

13. An arrangement according in claim 12, characterized in that said adjusting means is a control rack, said output control member is a drive pedal and said actuating member is a bell crank.

14. An arrangement according to claim 1, characterized in that the control travel of said diaphragm bolt is subdivided from the outermost position thereof in relation to the vacuum chamber, with increasing vacuum in said vacuum chamber, into an idling travel against the sole action of an idling spring, an adjoining adaptation travel with additional counter-force of an adaptation spring and an end-control travel following said adaptation travel and leading to the end position of said diaphragm bolt with an end-control spring further opposing the end-control travel of said diaphragm bolt.

15. An arrangement according to claim 1, characterized in that the engaging place of the diaphragm bolt at the control lever means is located, in the initial position of the diaphragm bolt, approximately on the connecting line between the full-load position of said pivot point and of the start-position of the point of pivotal connection of the control lever means on said adjusting means and at the same time approximately on the connecting line between the idling position of said pivot point and the maximum idling position of said point of pivotal connection, and in the opposite end position of the diaghragm bolt, at least approximately on the connecting line between the full-load position of said pivot point and the stop position of said point of pivotal connection.

16. An arrangement according to claim 1, characterized in that the full-load position of the actuating member is adjustable by means of an abutment member adjustably received in the housing of the injection pump.

17. An arrangement according to claim 1, characterized in that said vacuum line means includes, in the line section thereof on the engine side, a vacuum-booster means connected to a vacuum pump and, in the line section thereof on the control side, a three-way control valve means operable to selectively connect the line section on the control side, alternatively, with the line section leading to the vacuum-booster means, with the line section leading to the vacuum pump, or with the line section leading to the atmosphere.

18. An arrangement according to claim 17, characterized in that the vacuum-booster means includes a diaphragm and a drawspring engaging at said diaphragm and determining the initial pressure effective therein, said drawspring being adjustable in its tension force.

19. An arrangement according to claim 17, characterized in that the three-way control valve means is at the same time a component of an ignition lock means whose key is selectively rotatable from a shut-off position in which the measuring means is connected with the vacuum pump, into a starting position in which the measuring means is connected with the atmosphere, and into a drive position in which the measuring means is connected with the Venturi section of the suction pipe by way of said vacuum booster means.

* * * * *